US010566678B2

(12) United States Patent
Wu et al.

(10) Patent No.: US 10,566,678 B2
(45) Date of Patent: Feb. 18, 2020

(54) ANTENNA STRUCTURE AND ELECTRONIC DEVICE

(71) Applicant: PEGATRON CORPORATION, Taipei (TW)

(72) Inventors: Chien-Yi Wu, Taipei (TW); Chao-Hsu Wu, Taipei (TW); Ching-Hsiang Ko, Taipei (TW); Cheng-Hsiung Wu, Taipei (TW); Shih-Keng Huang, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 15 days.

(21) Appl. No.: 16/107,811

(22) Filed: Aug. 21, 2018

(65) Prior Publication Data

US 2019/0123423 A1 Apr. 25, 2019

(30) Foreign Application Priority Data

Oct. 24, 2017 (TW) ..... 106136586 A

(51) Int. Cl.
*H01Q 1/24* (2006.01)
*H01Q 1/22* (2006.01)
(Continued)

(52) U.S. Cl.
CPC ..... *H01Q 1/2266* (2013.01); *H01Q 1/243* (2013.01); *H01Q 1/38* (2013.01); *H01Q 1/48* (2013.01);
(Continued)

(58) Field of Classification Search
CPC ..... H01Q 5/371; H01Q 1/243; H01Q 1/38; H01Q 1/48; H01Q 7/00; H01Q 21/30
See application file for complete search history.

(56) References Cited

U.S. PATENT DOCUMENTS 9,136,590 B2 9/2015 Hotta et al.
2013/0113671 A1 5/2013 Su et al.
(Continued)

FOREIGN PATENT DOCUMENTS

CN 205811047 12/2016
TW 201320468 5/2013
(Continued)

*Primary Examiner* — Dieu Hien T Duong
(74) *Attorney, Agent, or Firm* — J.C. Patents

(57) ABSTRACT

An antenna structure including a metal outer cover and an antenna assembly is provided. The metal outer cover has a bent slit. The antenna assembly is stacked on the metal outer cover and covers a portion of the bent slit. The antenna assembly includes a substrate and an antenna pattern disposed on the substrate. The antenna pattern includes a feed end, a first ground end and a second ground end. In the antenna pattern, a first loop and a second loop are formed from the feed end to the first ground end in two respective paths. A third loop is formed from the feed end to the second ground end. The first loop and the third loop resonate with the bent slit to generate a low frequency band and a portion of a high frequency band. The second loop and the third loop resonate with the bent slit to generate another portion of the high frequency band. An electronic device having the antenna structure is further provided.

19 Claims, 12 Drawing Sheets

(51) Int. Cl.

| | |
|---|---|
| ***H01Q 1/48*** | (2006.01) |
| ***H01Q 21/30*** | (2006.01) |
| ***H01Q 5/371*** | (2015.01) |
| ***H01Q 7/00*** | (2006.01) |
| ***H01Q 1/38*** | (2006.01) |

(52) U.S. Cl.
CPC ..... *H01Q 5/371* (2015.01); *H01Q 7/00* (2013.01); *H01Q 21/30* (2013.01)

(56) References Cited

U.S. PATENT DOCUMENTS

| | | | | |
|---|---|---|---|---|
| 2015/0200443 | A1 | 7/2015 | Lo et al. | |
| 2016/0064832 | A1* | 3/2016 | Shin ..... | H01Q 1/243 343/702 |
| 2017/0005414 | A1 | 1/2017 | Yang | |
| 2017/0033467 | A1 | 2/2017 | Huang et al. | |
| 2017/0141452 | A1 | 5/2017 | Hsieh et al. | |
| 2017/0244171 | A1* | 8/2017 | Lee ..... | H01Q 25/30 |

FOREIGN PATENT DOCUMENTS

| | | |
|---|---|---|
| TW | 201703350 | 1/2017 |
| TW | 201705610 | 2/2017 |
| TW | 201716906 | 5/2017 |

* cited by examiner

ANTENNA STRUCTURE AND ELECTRONIC DEVICE

CROSS-REFERENCE TO RELATED APPLICATION

This application claims the priority benefit of Taiwan application serial no. 106136586, filed on Oct. 24, 2017. The entirety of the above-mentioned patent application is hereby incorporated by reference herein and made a part of this specification.

BACKGROUND

Technical Field

The present disclosure is related to an antenna structure and an electronic device, and particularly to an antenna structure having good performance and an electronic device having the antenna structure.

Description of Related Art

Recently, the material for the housing of some laptops have been changed from plastic to metal to meet consumers' requirement for appearance design and atheistic quality. However, due to the shielding effect of the metal housing, it is difficult for antenna to have good performance under the coverage of the metal housing. In addition, most laptops on the market have a recess thoroughly opened at an edge of one side of display panel, and the antenna is disposed in the recess. However, such configuration causes that the antenna occupies much space of the laptops, which is not helpful for the laptops to be developed with narrowframe; moreover, the atheistic quality of the laptops is affected.

SUMMARY

The present disclosure provides an antenna structure, which has antenna assembly that occupies less space of laptop, and thus making it possible for laptop to be developed with narrow frame and better appearance.

According to the present disclosure, an antenna structure includes a metal outer cover and an antenna assembly. The metal outer cover has a bent slit. The antenna assembly is stacked on the metal outer cover and covers a portion of the bent slit. The antenna assembly includes a substrate and an antenna pattern. The antenna pattern is disposed on the substrate. The antenna pattern includes a feed end, a first ground end and a second ground end. In the antenna pattern, a first loop and a second loop are formed from the feed end to the first ground end in two respective paths. A third loop is formed from the feed end to the second ground end. The first loop and the third loop resonate with the bent slit to generate a low frequency band and a portion of a high frequency band. The second loop and the third loop resonate with the bent slit to generate another portion of the high frequency band.

According to an embodiment of the present disclosure, the bent slit extends to an edge of the metal outer cover. The bent slit includes a first portion and a second portion individually extending in a first extending direction, and a third portion extending in a second extending direction. Two opposite ends of the third portion are individually connected with the first portion and the second portion, and a size of the first portion in the first extending direction is larger than a size of the second portion and the third portion in the first extending direction.

According to an embodiment of the present disclosure, the antenna pattern covers the first portion and a portion of the third portion of the bent slit.

According to an embodiment of the present disclosure, the antenna pattern further includes a first radiation unit, a second radiation unit and a third radiation unit extending in the first extending direction. Two opposite ends of the first radiation unit are bent and connected to the second radiation unit and the third radiation unit individually, wherein the first radiation unit in the first extending direction includes the feed end, a first block and a second block individually extending from two opposite ends of the feed end. The second radiation unit in the first extending direction includes the second ground end corresponding to the feed end and a third block extending from the second ground end. The second block is bent and connected to the third block. The third radiation unit in the first extending direction includes a fourth block located next to the second block, and the first ground end and a fifth block extending from two opposite ends of the fourth block individually, and a connection end which connects the fourth block with the feed end and connects the fourth block with the second block, and the first block is bent and connected to the fifth block.

According to an embodiment of the present disclosure, the feed end, the connection end, the fourth block and the first ground end form the first loop together; the feed end, the second block, the third block and the second ground end form the third loop together. The antenna pattern resonates with the bent slit to generate a low frequency band and a first band of a high frequency band through the first loop and the third loop.

According to an embodiment of the present disclosure, a bandwidth and a center frequency of the low frequency band and a bandwidth and a center frequency of the first band are adjustable with a width of the first ground end in the first extending direction, a width of a portion of the fourth block close to the first ground end in the second extending direction, or a sum of lengths of the second portion and the third portion.

According to an embodiment of the present disclosure, the third radiation unit further includes a first extension block extending from the fifth block to the second portion in the second extending direction, wherein the bandwidth and the center frequency of the low frequency band and the bandwidth and the center frequency of the first band are adjustable with the length of the first extension block in the second extending direction.

According to an embodiment of the present disclosure, the feed end, the first block, the fifth block, the fourth block and the first ground end form the second loop together; the feed end, the second block, the third block and the second ground end form the third loop together. The antenna pattern resonates with the bent slit to generate a second band and a third band of the high frequency band through the second loop and the third loop.

According to an embodiment of the present disclosure, impedance matching of the second band is adjustable with a position where the connection end connects the first radiation unit with the third radiation unit in the first extending direction, or a gap between the fifth block and a first wall surface of the first portion of the bent slit.

According to an embodiment of the present disclosure, a bandwidth and a center frequency of the second band are adjustable with a gap between the first block and a second wall surface of the first portion of the bent slit.

According to an embodiment of the present disclosure, the bandwidth and the center frequency of the second band and a bandwidth and a center frequency of the third band are adjustable with a gap between the third block and the second wall surface of the first portion of the bent slit.

According to an embodiment of the present disclosure, the first radiation unit further includes a second extension block extending from the feed end to the second block in the first extending direction, wherein the bandwidth and the center frequency of the second band and the center frequency of the third band are adjustable with the length of the second extension block in the first extending direction.

According to an embodiment of the present disclosure, the high frequency band includes the first band, the second band and the third band. The low frequency band ranges from 698 MHz to 894 MHz; the first band ranges from 1710 MHz to 1880 MHz; the second band ranges from 1850 MHz to 2170 MHz; and the third band ranges from 2300 MHz to 2700 MHz.

According to an embodiment of the present disclosure, the metal outer cover further includes a first ground layer disposed next to the bent slit, and the first ground end is electrically connected to the first ground layer.

According to an embodiment of the present disclosure, the metal outer cover further includes a second ground layer disposed next to the bent slit, and the second ground end is electrically connected to the second ground layer.

An electronic device of the present disclosure includes a first body. The first body includes a metal inner cover, a metal outer cover and two antenna assemblies. The metal outer cover is disposed on the metal inner cover, and two opposite sides of the metal outer cover having two bent slits. The two antenna assemblies are individually stacked on the metal outer cover, and individually cover a portion of the two bent slits. Each of the antenna assemblies includes a substrate and an antenna pattern. The antenna pattern includes a feed end, a first ground end and a second ground end. In the antenna pattern, a first loop and a second lop are formed from the feed end to the first ground end in respective paths. A third loop is formed from the feed end to the second ground end. The first loop and the third loop resonate with the bent slit to generate a low frequency band and a portion of a high frequency band; the second lop and the third loop resonate with the bent slit to generate another portion of the high frequency band.

According to an embodiment of the present disclosure, the first body includes a screen. The first body has a first frame and a second frame opposite to each other. A width of the first frame is larger than a width of the second frame, and the two antenna assemblies are individually disposed on two opposite sides of the first frame.

According to an embodiment of the present disclosure, the electronic device further includes a second body pivoted to a side of the first body to rotate relative to the first body. The two antenna assemblies are disposed in the first body close to the pivoting position.

According to an embodiment of the present disclosure, the electronic device further includes a wireless communication module. The two antenna assemblies further individually include two coaxial transmission lines electrically connected to the wireless communication module, wherein in each of the antenna assemblies, the feed end and the second ground end of the antenna pattern are electrically connected to a positive electrode and a negative electrode of the coaxial transmission line, respectively.

According to the above, in the electronic device of the present disclosure, the housing of the first body is formed by assembling the metal inner cover and the metal outer cover. Two opposite sides of the metal outer cover have two respective bent slits. The two antenna assemblies are stacked on the metal outer cover and cover a portion of the two bent slits. The antenna pattern includes the feed end, the first ground end and the second ground end. The first loop and the second loop are formed from the feed end to the first ground end in respective paths. The third loop is formed from the feed end to the second ground end so that the first loop and the third loop resonate with the bent slit to generate low frequency band and a portion of high frequency band; and the second loop and the third loop resonate with the bent slit to generate another portion of the high frequency band to achieve good performance. Additionally, the antenna assembly occupies less space in the laptop and therefore the laptop can be developed with narrow frame with better appearance.

In order to make the aforementioned features and advantages of the present disclosure more comprehensible, embodiments accompanying figures are described in detail below.

DETAILED DESCRIPTION

Figure 1:
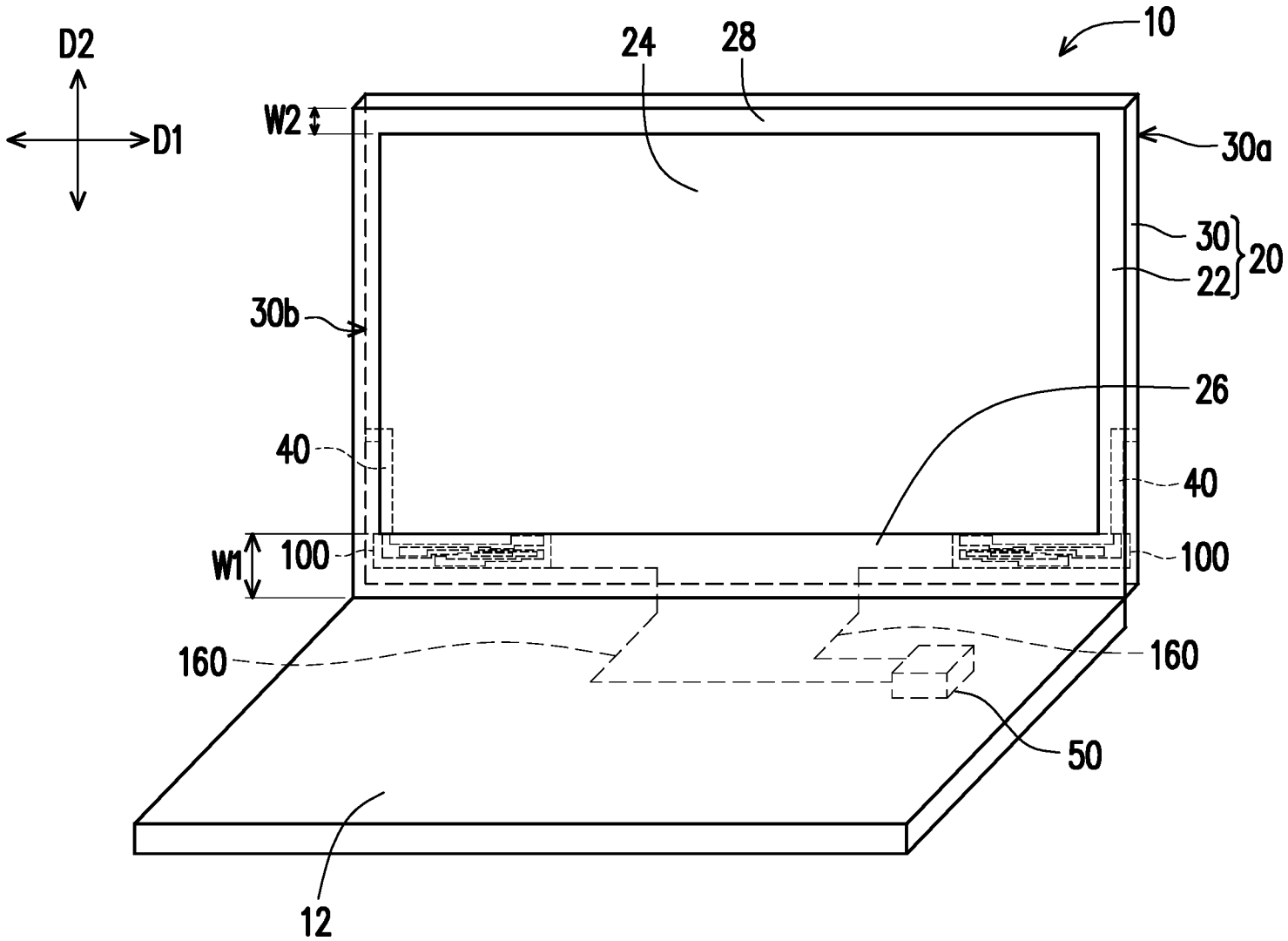
FIG. 1 is a schematic view of an electronic device according to an embodiment of the present disclosure.

FIG. 1 is a schematic view of an electronic device according to an embodiment the present disclosure. FIG. 1 shows the blocked external contour of a first body 20 with dashed lines. Referring to FIG. 1, an electronic device 10 in the embodiment includes the first body 20 and a second body 12. In the embodiment, the electronic device 10 is exemplified as a laptop, but the electronic device 10 in other embodiments may be, for example, a tablet PC with the first body 20, but the present disclosure has no limitation to the type of the electronic device 10. In the embodiment, the first body 20 is an upper body, and the second body 12 is a lower body. The second body 12 is pivoted to one side of the first body 20 to rotate relative to the first body 20.

As shown in FIG. 1, the first body 20 includes a screen 24 and two antenna assemblies 100. The first body 20 has a first frame relatively close to the pivoting position on the side with the screen 24 and has a second frame 28 relatively farther from the pivoting position, wherein a width W1 of the first frame 26 is larger than a width W2 of the second frame 28, and the two antenna assemblies 100 are disposed in the first body 20, and located at two opposite sides of the first frame 26. In the embodiment, by disposing the antenna assembly 100 at the first frame 26, it reduces the possibility that the antenna assembly 100 might take up spaces in the other frames of the first body 20, and therefore the electronic device can be developed with narrow frame. By individually disposing the two antenna assemblies 100 at two opposite sides of the first frame 26, it gives more flexibility for the layout design between the screen 24 and the second body 12.

On the other hand, the second body 12 includes a wireless communication module 50 disposed therein, the two antenna assemblies 100 are electrically connected to the wireless communication module 50 through two coaxial transmission lines 160. In the embodiment, since the position of the wireless communication module 50 is closer to the right, the length of the coaxial transmission line 160 on the right side is shorter, and the length of the coaxial transmission line 160 on the left side is longer, but the present disclosure provides no limitation to the relationship between the position of the wireless communication module 50 and the length of the two coaxial transmission lines 160. It should be noted that, in FIG. 1, since the two antenna assemblies 100, the two coaxial transmission lines 160 and the wireless communication module 50 are disposed in the first body 20, they are represented by dashed line.

In the embodiment, the housing of the second body 12 and the first body 20 of the electronic device 10 could be, for example, metal, and thus an appearance with good aesthetic quality. Typically, if the housing is metal, it is difficult for the antenna covered by metal housing to have good performance. The electronic device 10 in the embodiment is designed with special antenna structure such that the two antenna assemblies 100 can have good performance even if being disposed in the metal housing. Descriptions in this regard are provided in details below.

Figure 2A:
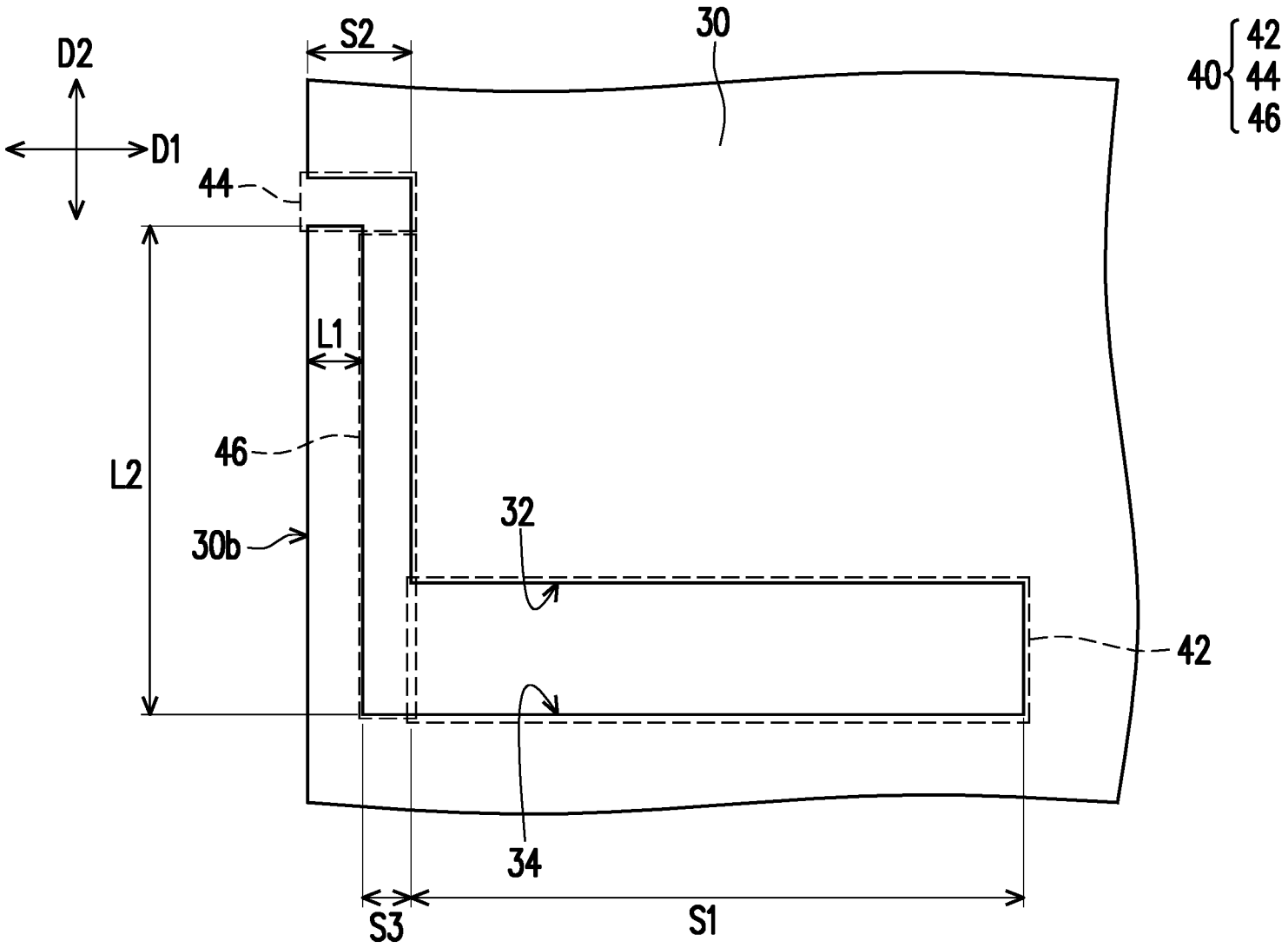
FIG. 2A and FIG. 2B are front views of part of a first body of the electronic device in FIG. 1.
Figure 2B:
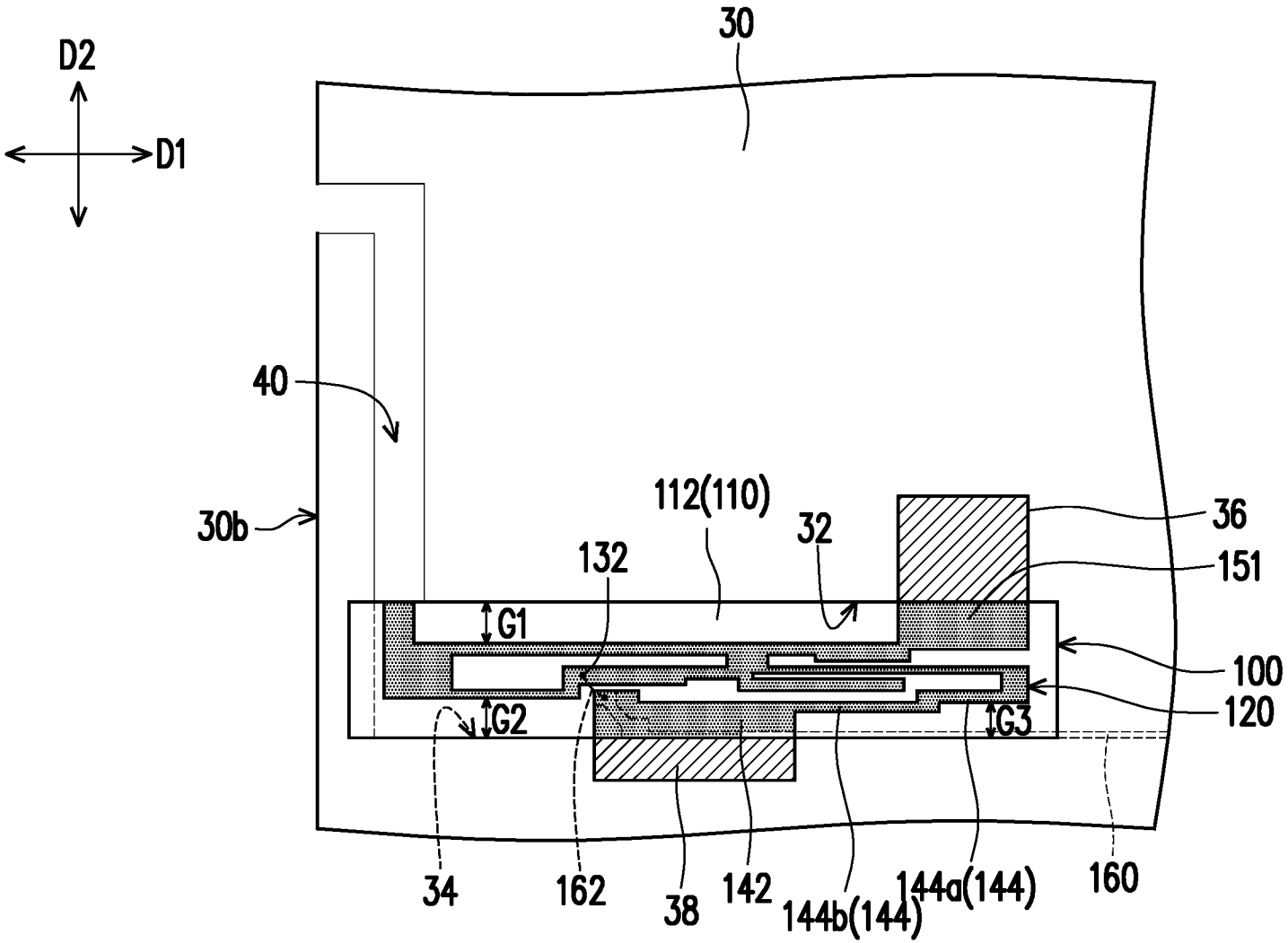

FIG. 2A and FIG. 2B are front views of a part of the first body of the electronic device in FIG. 1. It should be noted that, for better clarity and simplicity of description, FIG. 2A and FIG. 2B only briefly show a portion of a bent slit 40 on the left side of the first body 20 in the electronic device 10 as shown in FIG. 1, and the bent slit 40 is illustrated with thinner line in FIG. 2B. Additionally, FIG. 2B shows a configuration relationship between the antenna assembly 100 on the left side and the bent slit 40 on the left side in FIG. 1, but the bent slit 40 on the right side of the first body 20 also has the same and symmetrical configuration as the bent slit 40 on the left side.

Figure 3:
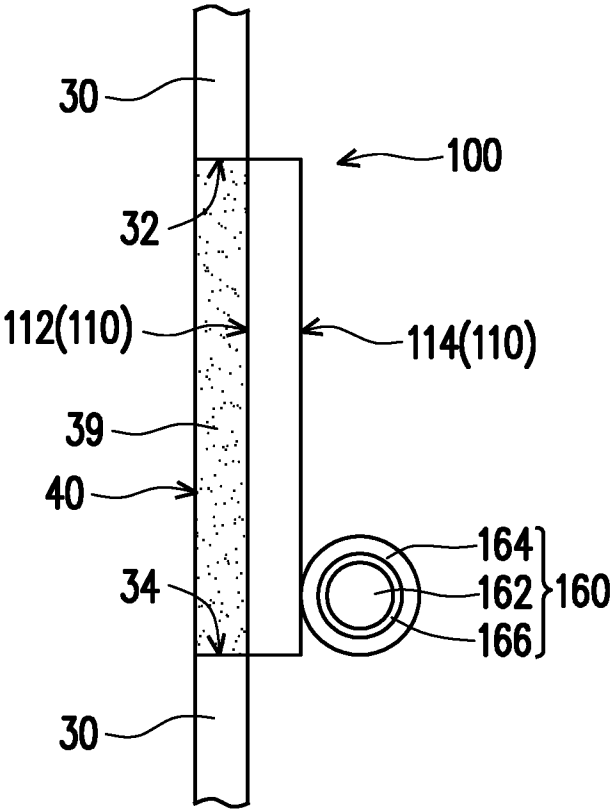
FIG. 3 is a right view of the first body of the electronic device in FIG. 2B.

FIG. 3 is a right view of the first body in the electronic device in FIG. 2B. Referring to FIG. 1 to FIG. 3, in the embodiment, the first body 20 includes a metal inner cover 22 and a metal outer cover 30. The metal outer cover 30 is disposed on the metal inner cover 22, and two opposite sides of the metal outer cover 30 have two bent slits 40, and the two antenna assemblies 100 are individually stacked on the metal outer cover 30 of the electronic device 10, and individually cover a portion of the two bent slits 40. Specifically, two bent slits 40 are individually disposed on the two opposite sides of the metal outer cover 30 close to the pivoting position. The two bent slits 40 individually penetrate through two opposite sides of the metal outer cover 30, and the two antenna assemblies 100 are individually stacked on a portion of the two bent slits 40 and cover a portion of the two bent slits 40. In the embodiment, the two bent slits 40 of the metal outer cover 30 are filled with plastic 39 or non-metallic object, thereby achieving the effect of preventing dust and protecting the inner element of the metal outer cover 30, but the bent slit 40 in other embodiments may not be filled with plastic 39 or other non-metallic object. In this manner, as compared with conventional technique which opens a whole recess on one side of the display panel, the two bent slits 40 in the embodiment of the present disclosure occupies less space of the metal outer cover 30, and therefore the metallic quality of the laptop can be enhanced and the appearance of the laptop can be improved.

Referring to FIG. 1, the two bent slits 40 extend towards edges 30*a* and 30*b* of the metal outer cover 30 of the electronic device 10, respectively. To describe the configuration in a concise manner, only the antenna assembly 100 on the left side and the bent slit 40 on the left side in FIG. 1 are described. Referring to FIG. 1 to FIG. 2B, the bent slit 40 includes a first portion 42 and a second portion 44 extending in a first extending direction D1, and a third portion 46 extending in a second extending direction D2, wherein two opposite ends of the third portion 46 individually connecting with the first portion 42 and the second portion 44. In other words, the third portion 46 is bent and extends from the first portion 42, the second portion 44 is bent and extends from the third portion 46, and the second portion 44 extends to reach the edge 30*a* of the metal outer cover 30 of the electronic device 10, wherein the antenna assembly 100 covers the first portion 42 and a portion of the third portion 46 of the bent slit 40. In the embodiment, a size S1 of the first portion 42 in the first extending direction D1 is larger than a size S2 of the second portion 44 in the first extending direction D1 and a size S3 of the third portion 46 in the first extending direction D1, both, but in other embodiments, the size of the first portion in the first extending direction may be larger or smaller than the size of the second portion in the first extending direction, and the size of the first portion in the first extending direction may be larger or smaller than the size of the third portion in the first extending direction, the present disclosure provides no limitation thereto.

Figure 4A:
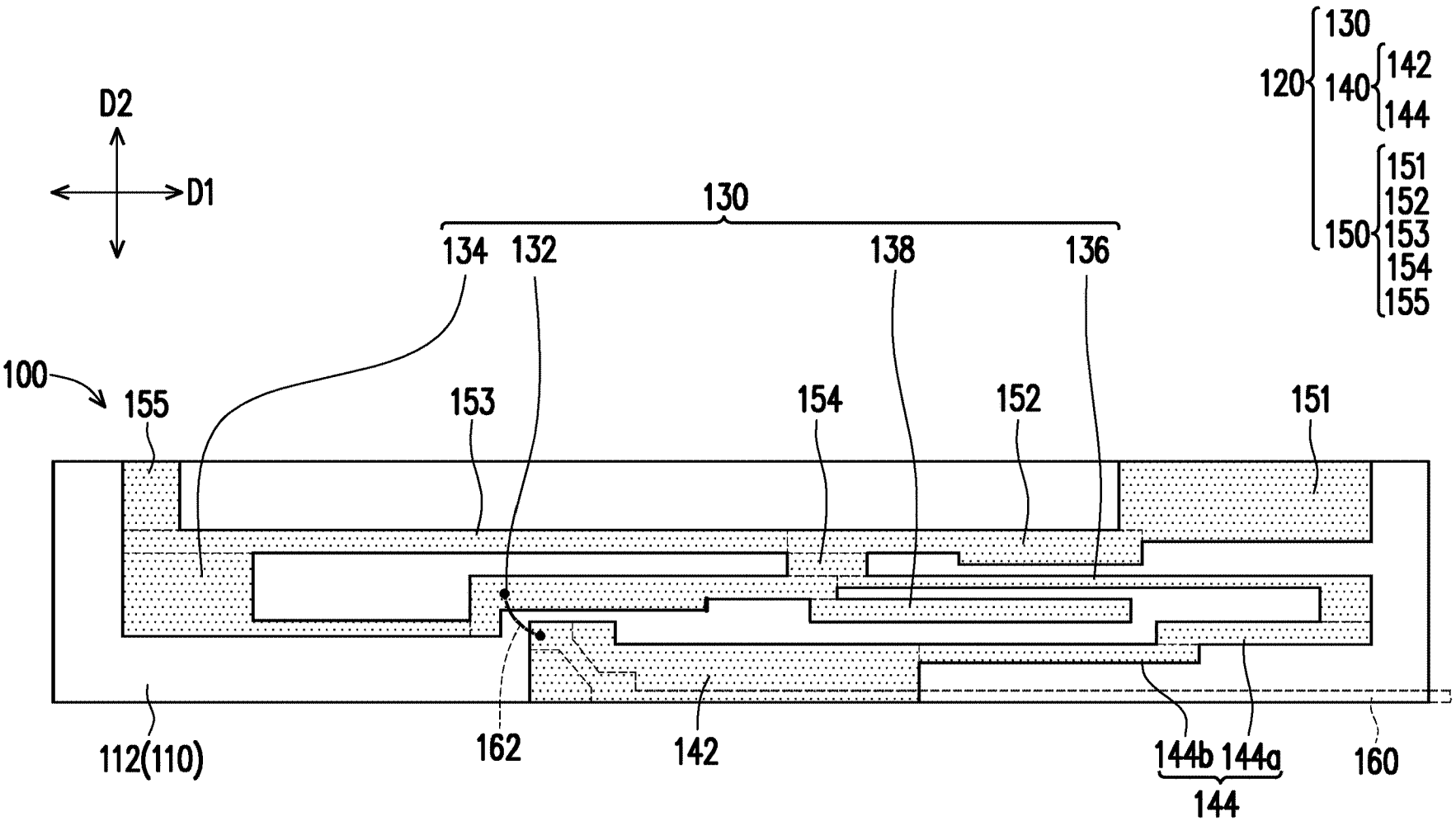
FIG. 4A to FIG. 4D are front views of part of an antenna assembly of the electronic device in FIG. 2B.

Detailed structure of the antenna assembly 100 is as shown in FIG. 4A. FIG. 4A is a front view of the antenna assembly of the electronic device in FIG. 2B. Referring to FIG. 4A, the antenna assembly 100 includes a substrate 110 and an antenna pattern 120 disposed on the substrate 110.

To be more specific, the antenna pattern 120 includes a first radiation unit 130, a second radiation unit 140 and a third radiation unit 150 individually extending in the first extending direction D1. Two opposite ends of the first radiation unit 130 are bent and connected to the second radiation unit 140 and the third radiation unit 150.

Furthermore, the first radiation unit 130 in the first extending direction D1 includes a feed end 132, and a first block 134 and a second block 136 extending from the two opposite ends of the feed end 132. The second radiation unit 140 in the first extending direction D1 includes a second ground end 142 corresponding to the feed end 132 and a third block 144 extending from the second ground end 142, wherein the first radiation unit 130 is bent and connected to the third block 144 through the second block 136. The third radiation unit 150 in the first extending direction D1 includes a fourth block 152 located next to the second block 136, a first ground end 151 and a fifth block 153 individually extending from two opposite ends of the fourth block 152, and a connection end 154 connecting the fourth block 152 with the feed end 132 and connecting the fourth block 152 with the second block 136.

Figure 4B:
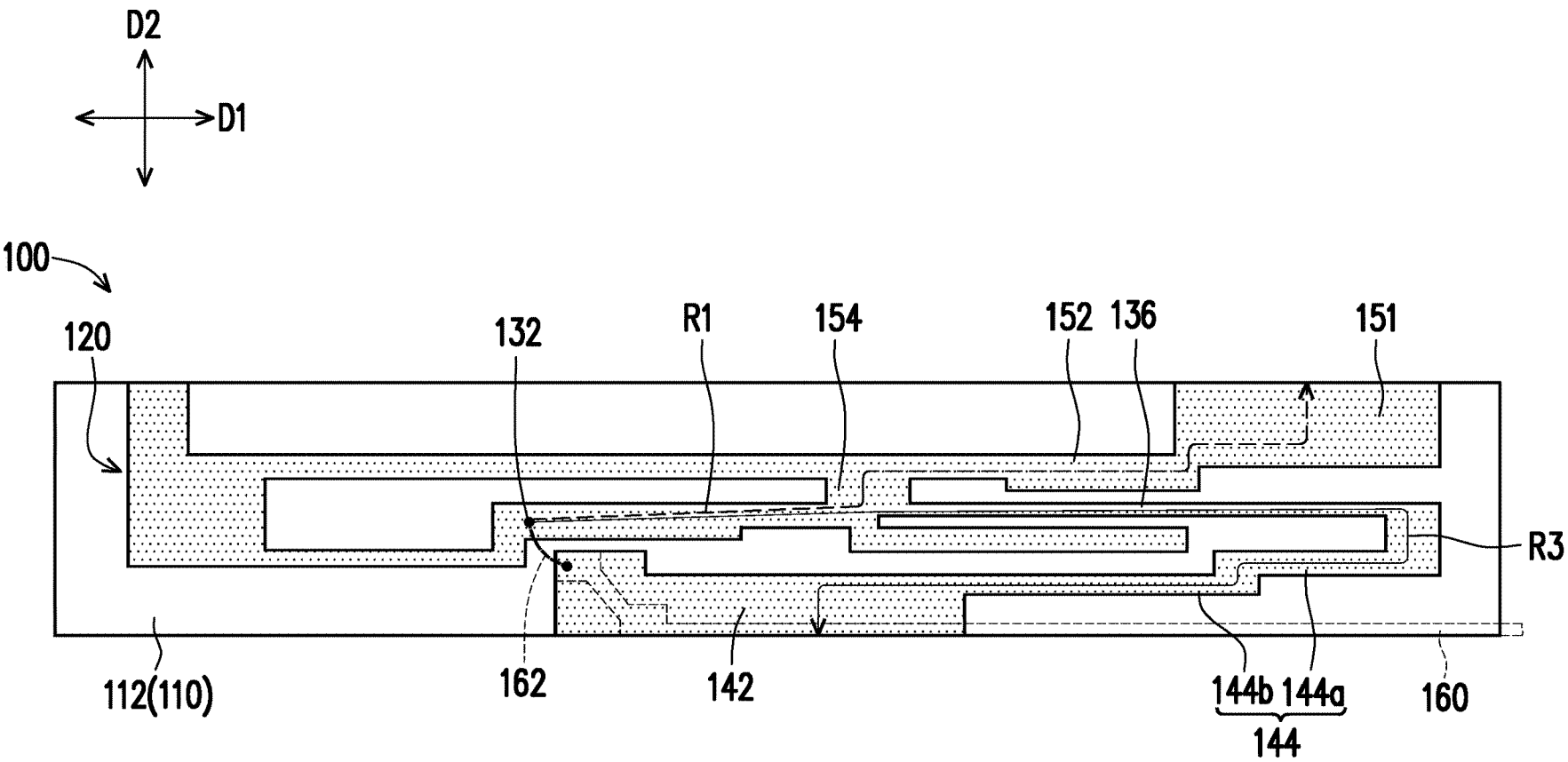
Figure 4C:
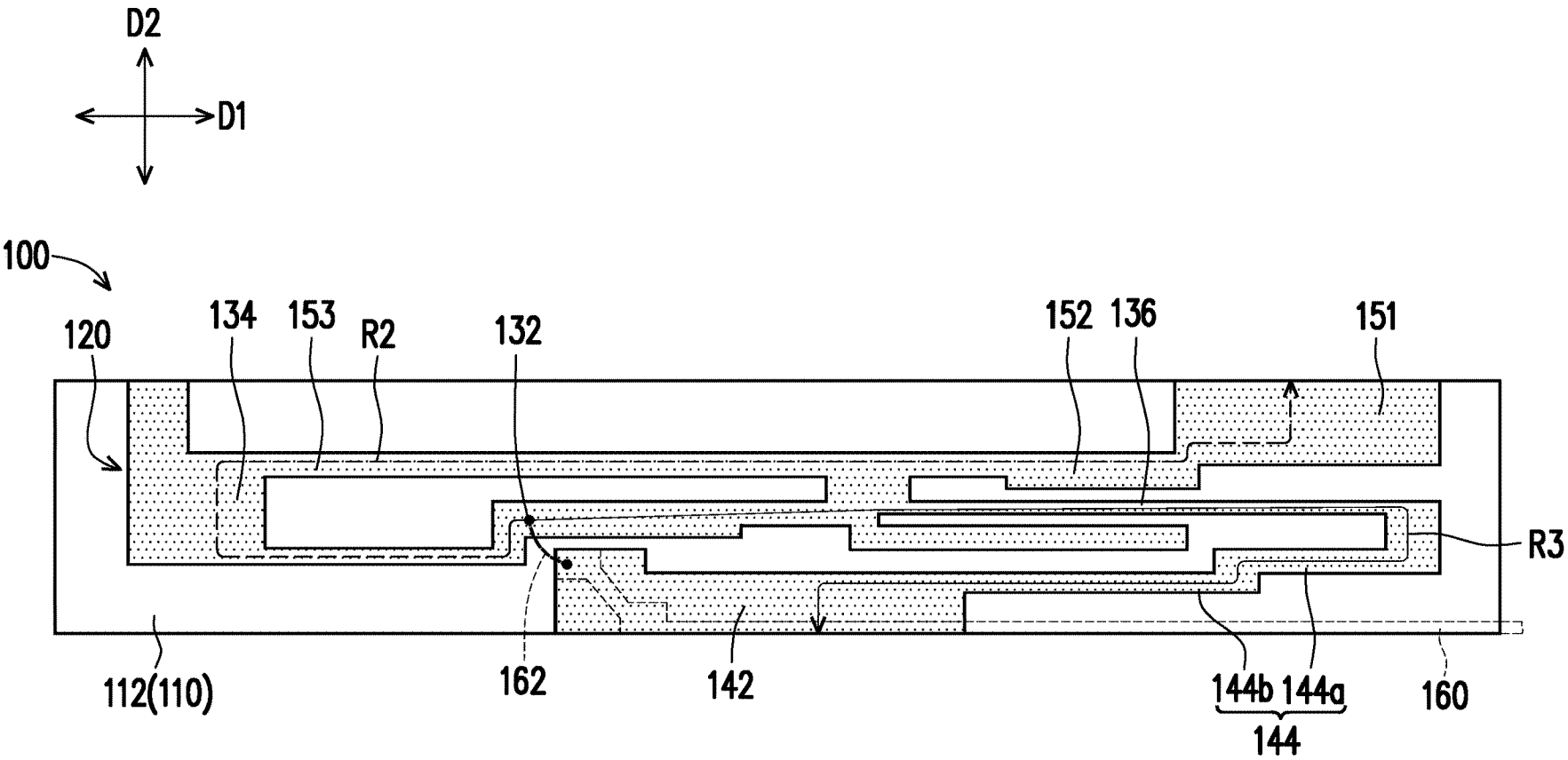

A first loop R1 and a third loop R3 formed by the antenna pattern 120 of the antenna assembly 100 are as shown in FIG. 4B. A second loop R2 and the third loop R3 formed by the antenna pattern 120 of the antenna assembly 100 are as shown in FIG. 4C. FIG. 4B and FIG. 4C are front views of part of the antenna assembly of the electronic device in FIG. 2B. Referring to FIG. 4A to FIG. 4C, in the embodiment, the configuration of the antenna pattern 120 allows the feed end 132, the connection end 154, the fourth block 152 and the first ground end 151 together form the first loop R1. The feed end 132, the first block 134, the fifth block 153, the forth block 152 and the first ground end 151 together form the second loop R2. The feed end 132, the second block 136, the third block 144 and the second ground end 142 together form the third loop R3. In other words, the first loop R1 and the second loop R2 may be formed from the feed end 132 to the first ground end 151 in two respective paths, and the third loop R3 is formed from the feed end 132 to the second ground end 142.

Referring to FIG. 1 to FIG. 4C, in the embodiment, the substrate 110 includes a first surface 112 (shown in FIG. 4A) and a second surface 114 (shown in FIG. 3) opposite to each other. The first surface 112 of the substrate 110 faces the bent slit 40 of the metal outer cover 30, and the antenna pattern 120 is disposed on the first surface 112 of the substrate 110.

Referring to FIG. 1 to FIG. 4C, in the embodiment, with the shape of the antenna pattern 120 and the configuration positions of the antenna pattern 120 and the bent slit 40, the antenna pattern 120 and the bent slit 40 can resonate to generate a low frequency band and a high frequency band. To be more specific, the antenna pattern 120 resonates with the bent slit 40 to generate the low frequency band and a portion of the high frequency band through the first loop R1 and the third loop R3. The antenna pattern 120 resonates with the bent slit 40 to generate in another portion of the high frequency band through the second loop R2 and the third loop R3.

In the embodiment, the high frequency band includes a first band, a second band and a third band. The antenna pattern 120 resonates with the bent slit 40 to generate the low frequency band and the first band of high frequency band through the first loop R1 and the third loop R3. The antenna pattern 120 resonates with the bent slit 40 to generate the second band and the third band of high frequency band through the second loop R2 and the third loop R3. In the embodiment, the low frequency band corresponds to frequency ranging from 698 MHz to 894 MHz, taking ¼ wavelength of the low LTE frequency as an example. The first band of the high frequency band corresponds to frequency ranging from 1710 MHz to 1880 MHz, taking the second harmonic of the LTE low frequency as an example. The second band of the high frequency band corresponds to frequency ranging from 1850 MHz to 2170 MHz, taking LTE high frequency as an example. The third band of the high frequency band corresponds to frequency ranging from 2300 MHz to 2700 MHz, taking LTE high frequency as an example. But the present disclosure provides no limitation to the frequency of the low frequency band and the first band, the second band and the third band of the high frequency band.

Figure 4D:
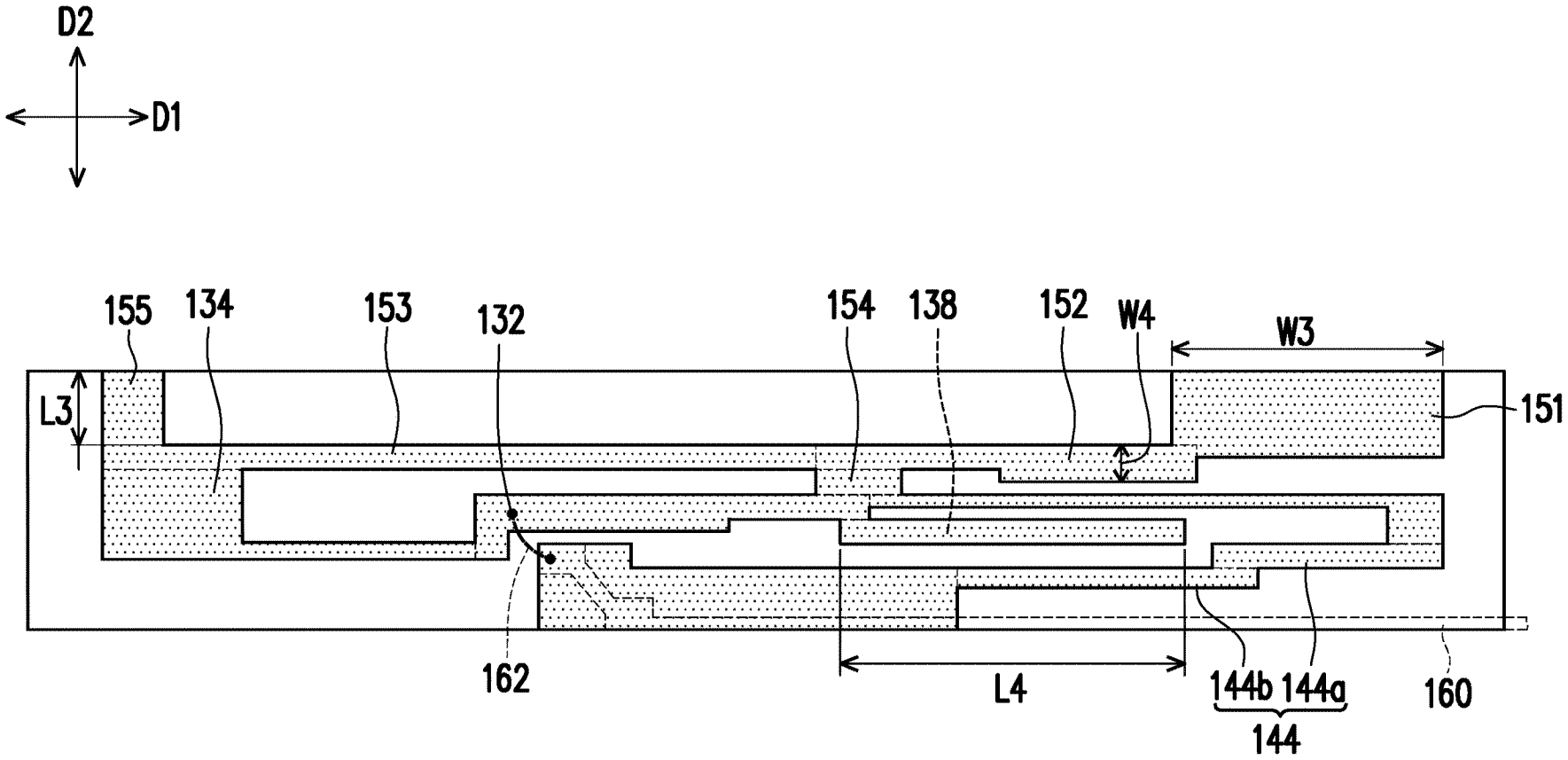

FIG. 4D is a front view of an antenna assembly of the electronic device in FIG. 2B. Referring to FIG. 2 to FIG. 4D, it should be noted that center frequency or the bandwidths of low frequency band and high frequency band may be adjustable with the change of the antenna pattern 120. In the embodiment, the third radiation unit 150 further includes a first extension block 155 extending from the fifth block 153 to the second portion 44 in the second extending direction D2. The bandwidths and the center frequencies of the low frequency band and the high frequency band may be adjustable with a width W3 of the first ground end 151 in the first extending direction D1, a width W4 of an end portion of the fourth block 152, which is close to the first ground end 151, in the second extending direction D2, the sum of the length L1 of the second portion 44 in the first extending direction D1 and the length L2 of the third portion 46 in the second extending direction D2, or a length L3 of the first extension block 155 in the second extending direction D2.

On the other hand, impedance matching of the second band of the high frequency band may be adjustable with the position where the connection end 154 connects the first radiation unit 130 with the third radiation unit 150 in the first extending direction D1, or a gap G1 between the fifth block 153 and a first wall surface 32 of the first portion 42 of the bent slit 40. Furthermore, the bandwidth and the center frequency of the second band of the high frequency band may be adjustable with a gap G2 between the first block 134 and a second wall surface 34 of the first portion 42 of the bent slit 40. Additionally, the first radiation unit 130 further includes a second extension block 138 extending from the feed end 132 to the second block 136 in the first extending direction D1. The third block 144 of the second radiation unit 140 includes third blocks 144*a* and 144*b*. The bandwidths and the center frequencies of the second band and the third band of the high frequency band may be adjustable with a gap G3 between the third block 144*a* and the second wall surface 34 of the first portion 42 of the bent slit 40, a length L4 of the second extension block 138 in the first extending direction D1.

In the embodiment, the metal outer cover 30 further includes a first ground layer 36 and a second ground layer 38. The material of the metal outer cover 30 is, for example, copper, but the present disclosure provides no limitation thereto. The first ground layer 36 is disposed next to the bent slit 40 and partially covers the first ground end 151 of the antenna pattern 120 for electrically connecting to the first ground end 151. The second ground layer 38 is disposed next to the bent slit 40 and partially covers the second ground end 142 of the antenna pattern 120 for electrically connecting to the second ground end 142.

As shown in FIG. 3, the antenna assembly 100 further includes a coaxial transmission line 160 disposed on the second surface 114 and configured to transmit the antenna signal to the wireless communication module 50 (shown in FIG. 1). The coaxial transmission line 160 includes a signal line 162 located in the inner layer, a ground line 164 located in the outer layer and an insulating layer 166 insulating the signal line 162 from the ground line 164.

Since the coaxial transmission line 160 is disposed on the second surface 114 of the substrate 110, the coaxial transmission line 160 is represented by dashed line in FIG. 2B, FIG. 4A to FIG. 4D. Referring to FIG. 2B to FIG. 4D, the coaxial transmission line 160 on the second surface 114 of the substrate 110 extends from the position corresponding to the third block 144 of the second radiation unit 140 to the position corresponding to the second ground end 142, and the signal line 162 of the coaxial transmission line 160 extends to the position corresponding to the feed end 132. In the embodiment, the feed end 132 is electrically connected to the signal line 162 (i.e., electrically connected to the positive electrode) of the coaxial transmission line 160, and the second ground end 142 is electrically connected to the ground line 164 (i.e., electrically connected to negative electrode) of the coaxial transmission line 164.

Figure 5:
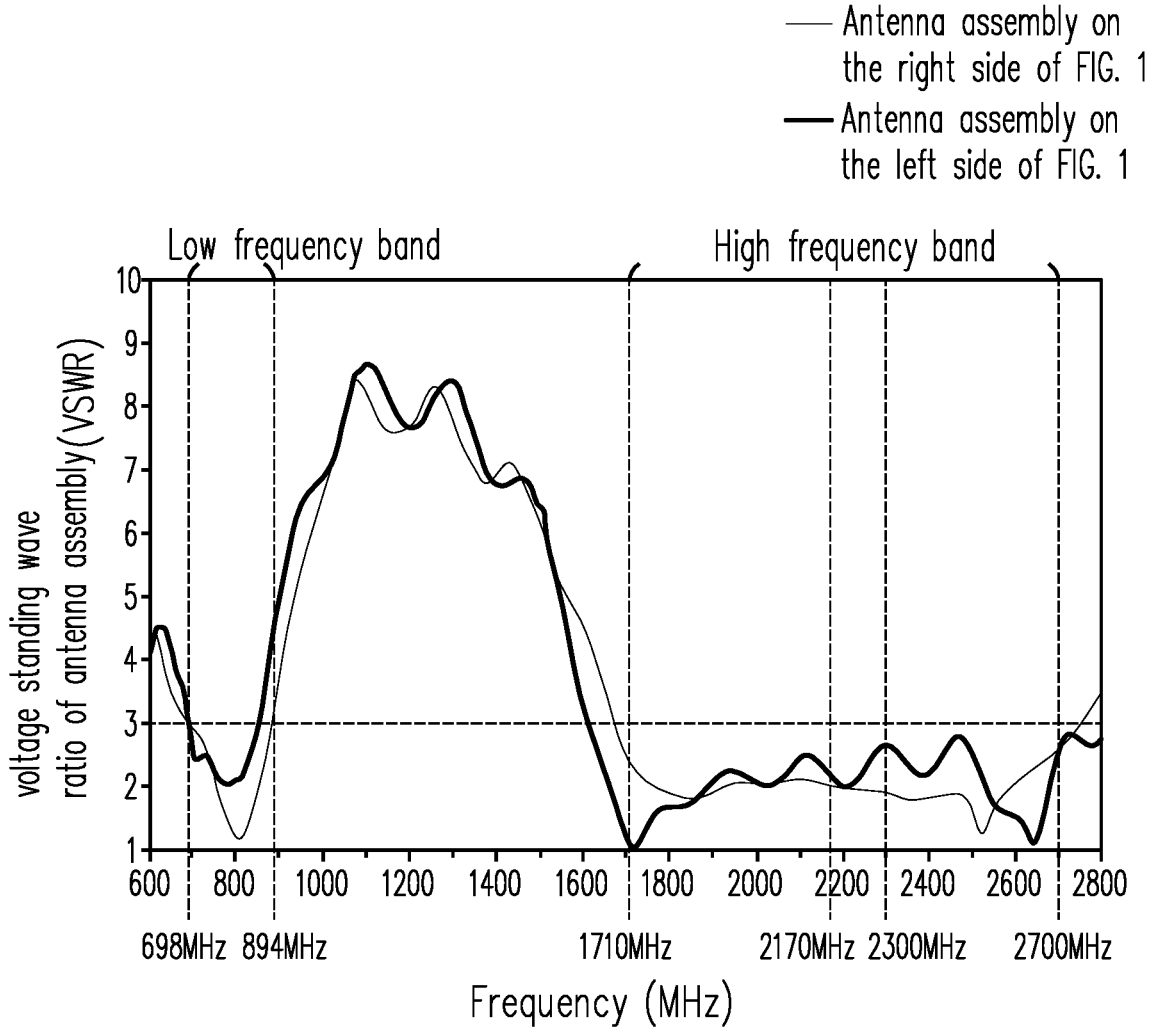
FIG. 5 is a plot of frequency vs. voltage standing wave ratio of the antenna structure of the electronic device in FIG. 1.

Below is an actual test of performances of the antenna structure of the electronic device in FIG. 1. FIG. 5 is a plot of frequency vs. voltage standing wave ratio (VSWR) of the antenna structure of the electronic device in FIG. 1. Referring to FIG. 5, the VSWRs of the two antenna assemblies 100 on the right and left sides of FIG. 1 are mostly below 3 dB in the low frequency band (LTE low frequency, corresponding to frequency ranging from 698 MHz to 894 MHz) and high frequency band (LTE high frequency, corresponding to frequency ranging from 1710 MHz to 2700 MHz), and thus achieving better performance.

Figure 6:
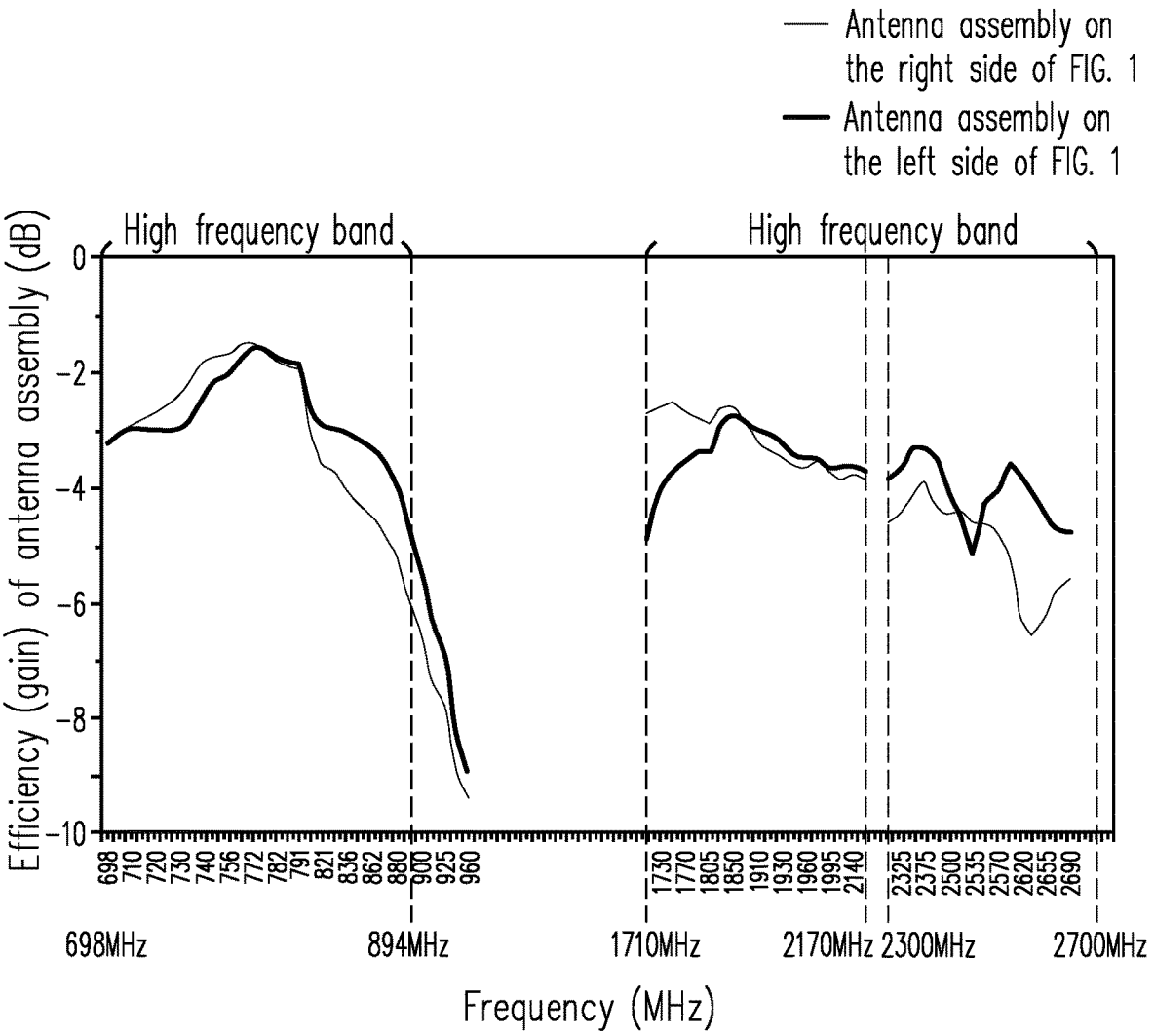
FIG. 6 is a plot of frequency vs. antenna efficiency of the antenna structure the electronic device in FIG. 1.

FIG. 6 is a plot of frequency vs. antenna efficiency of the antenna structure of the electronic device in FIG. 1. Referring to FIG. 6, the antenna efficiency of the two antenna assemblies 100 on the right and left sides of FIG. 1 is from −1.5 dB to −5.8 dB in low frequency band (LTE low frequency, corresponding to frequency ranging from 698 MHz to 894 MHz), and the antenna efficiency in high frequency band (LTE high frequency, corresponding to frequency ranging from 1710 MHz to 2700 MHz) and the second band of high frequency band (LTE high frequency, corresponding to frequency ranging from 1850 MHz to 2170 MHz) is from −2.6 dB to −6.5 dB, both of which achieve good performance in antenna efficiency.

Figure 7:
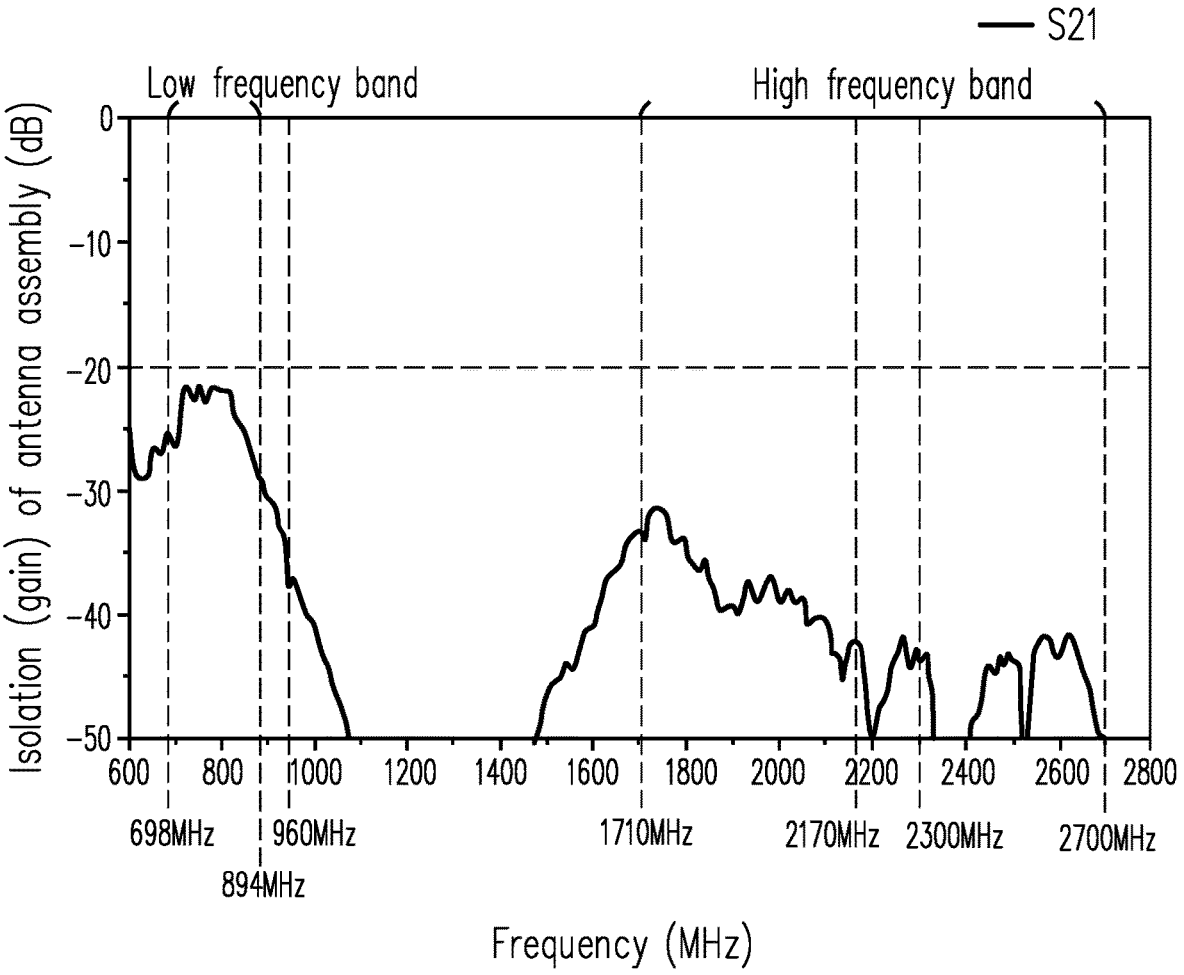
FIG. 7 is a plot of frequency vs. isolation of the antenna structure of the electronic device in FIG. 1.

FIG. 7 is a plot of frequency vs. isolation of the antenna structure of the electronic device in FIG. 1. Referring to FIG. 1 and FIG. 7, since the relative distance between the two antenna assemblies 100 on the right and left sides of FIG. 1 is farther (larger than or equal to 200 mm), the isolation between the two antenna assemblies 100 may be lower than −20 dB in low frequency band (LTE low frequency, corresponding to frequency ranging from 698 MHz to 894 MHz) and high frequency band (LTE high frequency, corresponding to frequency ranging from 1710 MHz to 2700 MHz).

Figure 8:
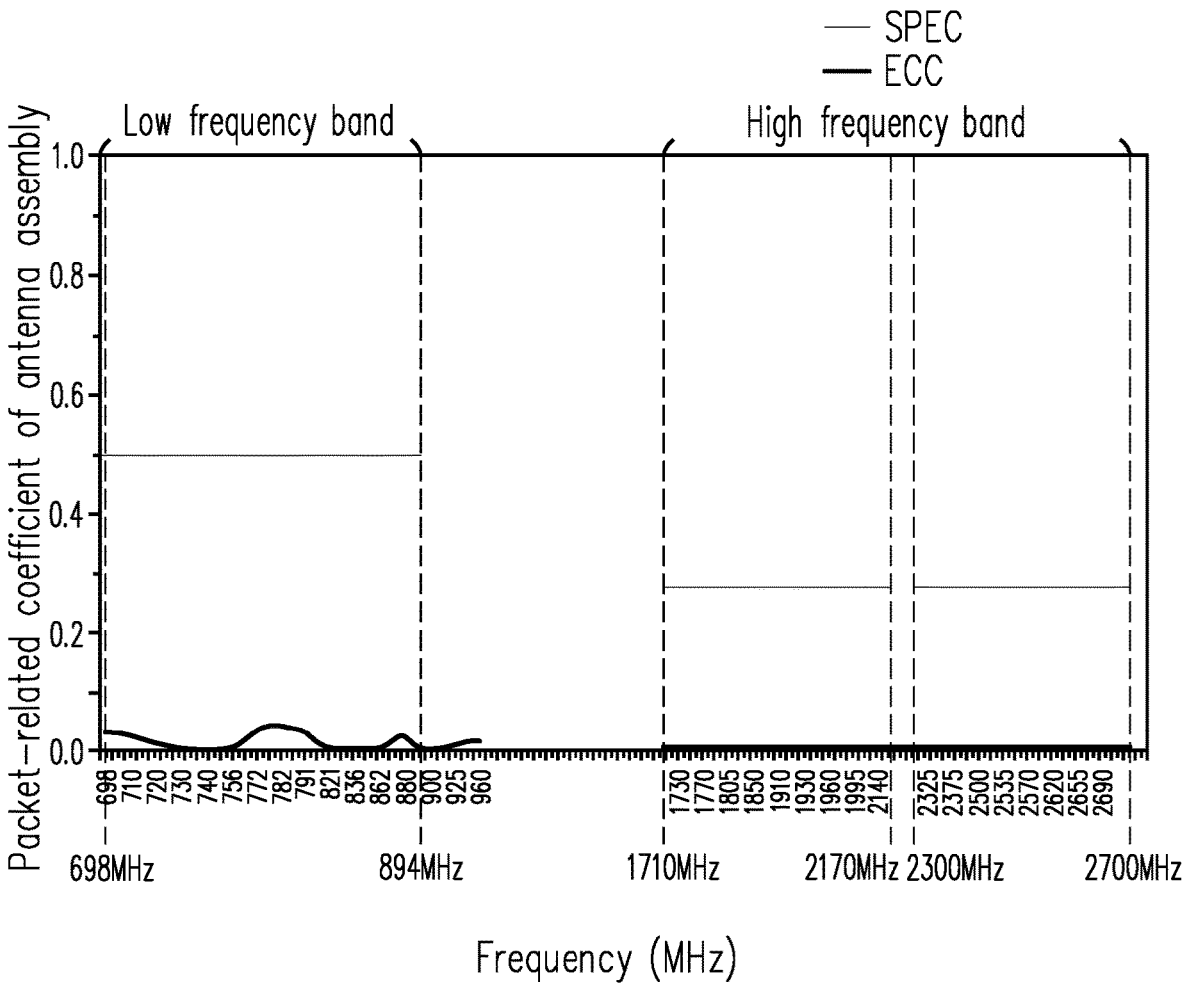
FIG. 8 is a plot of frequency and packet-related coefficient of the antenna structure of the electronic device in FIG. 1.

FIG. 8 is a plot of frequency vs. packet-related coefficient of the antenna structure of the electronic device in FIG. 1. Referring to FIG. 1 and FIG. 7, since the relative distance between the two antenna assemblies 100 on the right and left sides of FIG. 1 is farther (larger than or equal to 200 mm), the packet-related coefficient of the two antenna assemblies 100 may be lower than 0.5 in low frequency band (LTE low frequency, corresponding to frequency ranging from 698 MHz to 894 MHz), and the packet-related coefficient of the two antenna assemblies 100 in high frequency band (LTE high frequency, corresponding to frequency ranging from 1710 MHz to 2700 MHz) may be lower than 0.3.

In summary, in the electronic device of the present disclosure, the housing of the first body is formed by assembling the metal inner cover and the metal outer cover. Two opposite sides of the metal outer cover have two bent slits. The two antenna assemblies are stacked on the metal outer cover and cover a portion of the two bent slits. The antenna pattern includes the feed end, the first ground end and the second ground end. The first loop and the second loop are formed from the feed end to the first ground end in respective paths. The third loop is formed from the feed end to the second ground end so that the first loop and the third loop resonate with the bent slit to generate the low frequency band and a portion of high frequency band, and the second loop and the third loop resonate with the bent slit to generate another portion of the high frequency band to achieve good performance. Additionally, the antenna assembly occupies less space in the laptop and therefore the laptop can be developed with narrow frame with better appearance.

Although the present disclosure has been disclosed by the above embodiments, the embodiments are not intended to limit the present disclosure. It will be apparent to those skilled in the art that various modifications and variations can be made to the structure of the present disclosure without departing from the scope or spirit of the present disclosure. Therefore, the protecting band of the present disclosure falls in the appended claims.

What is claimed is:

1. An antenna structure, comprising:
a metal outer cover, having a bent slit; and
an antenna assembly, stacked on the metal outer cover and covering a portion of the bent slit, the antenna assembly comprising:
a substrate; and
an antenna pattern disposed on the substrate, the antenna pattern comprising a feed end, a first ground end and a second ground end, in the antenna pattern, a first loop and a second loop individually being formed from the feed end to the first ground end in two respective paths, a third loop being formed from the feed end to the second ground end, the first loop and the third loop resonating with the bent slit to generate a low frequency band and a portion of a high frequency band, the second loop and the third loop resonating with the bent slit to generate another portion of the high frequency band.

2. The antenna structure according to claim 1, wherein the bent slit extends to an edge of the metal outer cover, and the bent slit comprises a first portion and a second portion extending in a first extending direction, and a third portion extending in a second extending direction, wherein two opposite ends of the third portion are individually connected with the first portion and the second portion, and a size of the first portion in the first extending direction is larger than sizes of the second portion and the third portion in the first extending direction.

3. The antenna structure according to claim 2, wherein the antenna pattern covers the first portion and a portion of the third portion of the bent slit.

4. The antenna structure according to claim 2, wherein the antenna pattern further comprises a first radiation unit, a second radiation unit and a third radiation unit extending in the first extending direction; two opposite ends of the first radiation unit are bent and connected to the second radiation unit and the third radiation unit individually; wherein, the first radiation unit in the first extending direction comprises the feed end, a first block and a second block individually extending from two opposite ends of the feed end; the second radiation unit in the first extending direction comprises the second ground end corresponding to the feed end and a third block extending from the second ground end, wherein the second block is bent and connected to the third block; the third radiation unit in the first extending direction comprises a fourth block located next to the second block, the first ground end and a fifth block extending from two opposite ends of the fourth block individually and a connection end connecting the fourth block with the feed end and connecting the fourth block with the second block, wherein the first block is bent and connected to the fifth block.

5. The antenna structure according to claim 4, wherein the feed end, the connection end, the fourth block and the first ground end form the first loop together; the feed end, the second block, the third block and the second ground end form the third loop together; the antenna pattern resonates with the bent slit to generate the low frequency band and a first band of the high frequency band through the first loop and the third loop.

6. The antenna structure according to claim 5, wherein a bandwidth and a center frequency of the low frequency band and a bandwidth and a center frequency of the first band are adjustable with a width of the first ground end in the first extending direction, a width of the fourth block close to the first ground end in the second extending direction, or a sum of lengths of the second portion and the third portion.

7. The antenna structure according to claim 5, wherein the third radiation unit further comprises a first extension block extending from the fifth block towards the second portion in the second extending direction, wherein a bandwidth and a center frequency of the low frequency band and a bandwidth and a center frequency of the first band are adjustable with a length of the first extension block in the second extending direction.

8. The antenna structure according to claim 4, wherein the feed end, the first block, the fifth block, the fourth block and the first ground end form the second loop together, the feed end, the second block, the third block and the second ground end form the third loop together, the antenna pattern resonates with the bent slit to generate a second band and a third band of the high frequency band through the second loop and the third loop.

9. The antenna structure according to claim 8, wherein impedance matching for the second band is adjustable with a position where the connection end connects the first radiation unit with the third radiation unit in the first extending direction, or a gap between the fifth block and a first wall surface of the first portion of the bent slit.

10. The antenna structure according to claim 8, wherein a bandwidth and a center frequency of the second band are adjustable with a gap between the first block and a second wall surface of the first portion of the bent slit.

11. The antenna structure according to claim 8, wherein a bandwidth and a center frequency of the second band and a bandwidth and a center frequency of the third band are adjustable with a gap between the first block and a second wall surface of the first portion of the bent slit.

12. The antenna structure according to claim 8, wherein the first radiation unit further comprises a second extension block extending from the feed end towards the second block in the first extending direction, wherein a bandwidth and a center frequency of the second band and a bandwidth and a center frequency of the third band are adjustable with a length of the second extension block in the first extending direction.

13. The antenna structure according to claim 1, wherein the high frequency band comprises a first band, a second band and a third band, wherein the low frequency band ranges from 698 MHz to 894 MHz, the first band ranges from 1710 MHz to 1880 MHz, the second band ranges from 1850 MHz to 2170 MHz, and the third band ranges from 2300 MHz to 2700 MHz.

14. The antenna structure according to claim 1, wherein the metal outer cover further comprises a first ground layer disposed next to the bent slit, and the first ground end is electrically connected to the first ground layer.

15. The antenna structure according to claim 1, wherein the metal outer cover further comprises a second ground layer disposed next to the bent slit, and the second ground end is electrically connected to the second ground layer.

16. An electronic device, comprising:

a first body, comprising:

a metal inner cover;

a metal outer cover disposed on the metal inner cover, and two opposite sides of the metal outer cover having two bent slits; and two antenna assemblies, individually stacked on the metal outer cover, and individually covering a portion of the two bent slits, each of the antenna assemblies comprising:

a substrate; and an antenna pattern, disposed on the substrate, the antenna pattern comprising a feed end, a first ground end and a second ground end, in the antenna pattern, a first loop and a second loop are formed from the feed end to the first ground end in respective paths, a third loop is formed from the feed end to the second ground end, the first loop and the third loop resonate with the bent slit to generate a low frequency band and a portion of a high frequency band, the second loop and the third loop resonate with the bent slit to generate in another portion of the high frequency band.

17. The electronic device according to claim 16, wherein the first body comprises a screen, the first body has a first frame and a second frame opposite to each other on a side with the screen, a width of the first frame is larger than a width of the second frame, and the two antenna assemblies are individually located at two opposite sides of the first frame.

18. The electronic device according to claim 16, further comprising a second body pivoted to a side of the first body to rotate relative to the first body, the two antenna assemblies located in the first body close to the pivoting position.

19. The electronic device according to claim 16, further comprising a wireless communication module, the two antenna assemblies further individually comprising two coaxial transmission lines electrically connected to the wireless communication module, wherein in each of the antenna assemblies, the feed end and the second ground end of the antenna pattern are electrically connected to a positive electrode and a negative electrode of the coaxial transmission line, respectively.

* * * * *